US009673531B2

(12) United States Patent
Chan et al.

(10) Patent No.: US 9,673,531 B2
(45) Date of Patent: Jun. 6, 2017

(54) ANTENNA

(71) Applicants: Yun Ghit Chan, Shenzhen (CN); Ng Guan Hong, Shenzhen (CN); Yew Siow Tay, Shenzhen (CN)

(72) Inventors: Yun Ghit Chan, Shenzhen (CN); Ng Guan Hong, Shenzhen (CN); Yew Siow Tay, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 119 days.

(21) Appl. No.: 14/592,076

(22) Filed: Jan. 8, 2015

(65) Prior Publication Data

US 2015/0200457 A1 Jul. 16, 2015

(30) Foreign Application Priority Data

Jan. 10, 2014 (CN) ..... 2014 1 0013088

(51) Int. Cl.

| | |
|---|---|
| ***H01Q 5/00*** | (2015.01) |
| ***H01Q 9/40*** | (2006.01) |
| ***H01Q 5/371*** | (2015.01) |
| ***H01Q 5/357*** | (2015.01) |
| *H01Q 5/392* | (2015.01) |
| *H01Q 5/385* | (2015.01) |
| *H01Q 5/378* | (2015.01) |

(52) U.S. Cl.

CPC ..... *H01Q 9/40* (2013.01); *H01Q 5/357* (2015.01); *H01Q 5/371* (2015.01); *H01Q 5/378* (2015.01); *H01Q 5/385* (2015.01); *H01Q 5/392* (2015.01)

(58) Field of Classification Search

CPC ..... H01Q 5/371; H01Q 5/378; H01Q 5/385; H01Q 5/392; H01Q 5/357

See application file for complete search history.

(56) References Cited

U.S. PATENT DOCUMENTS

| | | | | |
|---|---|---|---|---|
| 2008/0030405 | A1* | 2/2008 | Tsai | H01Q 9/42 343/700 MS |
| 2008/0136711 | A1* | 6/2008 | Lai | H01Q 1/243 343/700 MS |
| 2009/0237308 | A1* | 9/2009 | Tsai | H01Q 1/2266 343/700 MS |
| 2010/0253581 | A1* | 10/2010 | Tsou | H01Q 1/38 343/702 |
| 2012/0299779 | A1* | 11/2012 | Yen | H01Q 1/243 343/700 MS |
| 2015/0042517 | A1* | 2/2015 | Chang | H01Q 5/385 343/700 MS |
| 2015/0061943 | A1* | 3/2015 | Chi | H01Q 21/30 343/700 MS |

* cited by examiner

*Primary Examiner* — Dameon E Levi
*Assistant Examiner* — Jennifer F Hu
(74) *Attorney, Agent, or Firm* — Na Xu; IPro, PLLC

(57) ABSTRACT

An antenna is disclosed. The antenna includes a coupling portion, a ground connection portion corresponding to the coupling portion, and a radiation body. The a radiation body further includes a first antenna portion extending from a first end of the coupling portion in a direction, a second antenna portion extending from the first end in a direction opposite to that of the first antenna portion, and a third antenna portion extending from an end of the ground connection portion in a direction surrounding the first antenna portion, wherein two gaps are provided for separating the third antenna portion from the first antenna portion and the second antenna portion respectively.

11 Claims, 3 Drawing Sheets

ANTENNA

FIELD OF THE INVENTION

The disclosure described herein relates to mobile devices, and more particularly to an antenna used in such a mobile device.

DESCRIPTION OF RELATED ART

With the fast development of mobile communication technology, 4G technology, as a combination of 3G and WLAN, has obvious superiorities over other conventional communication technologies, especially for its advanced performances on transferring signals. LTE (Long Term Evolution) is a global general standard covered in 4G technologies, and has been widely used in mobile devices, such as smart phones, laptops, tablet PCs, and even the GPS devices.

Compared with conventional 3G technology, one major improvement of LTE lies in the feature of MIMO (Multiple-input and multiple-output), to meet the requirement of high data throughputs with a strong receive signal and a high signal-to-noise ratio (SNR). Therefore, the mobile devices in LTE are requested to be provided with an antenna capable of supporting multi-band and broad bands.

An antenna related to the present disclosure includes a coupling portion, a first and second radiation bodies extending out from one end of the coupling portion, and a ground connection portion corresponding to the coupling portion, wherein the first radiation body is coupled with the second radiation body. A defect of such antennas is that it can only function in one predetermined frequency band, thus failing to meet the demand of the present mobile device for multi-band and broad bands.

Accordingly, an improved antenna which can overcome the defects mentioned above is desired.

BRIEF DESCRIPTION OF THE DRAWINGS

Many aspects of the embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENT

The present invention will hereinafter be described in detail with reference to an exemplary embodiment.

Figure 1:
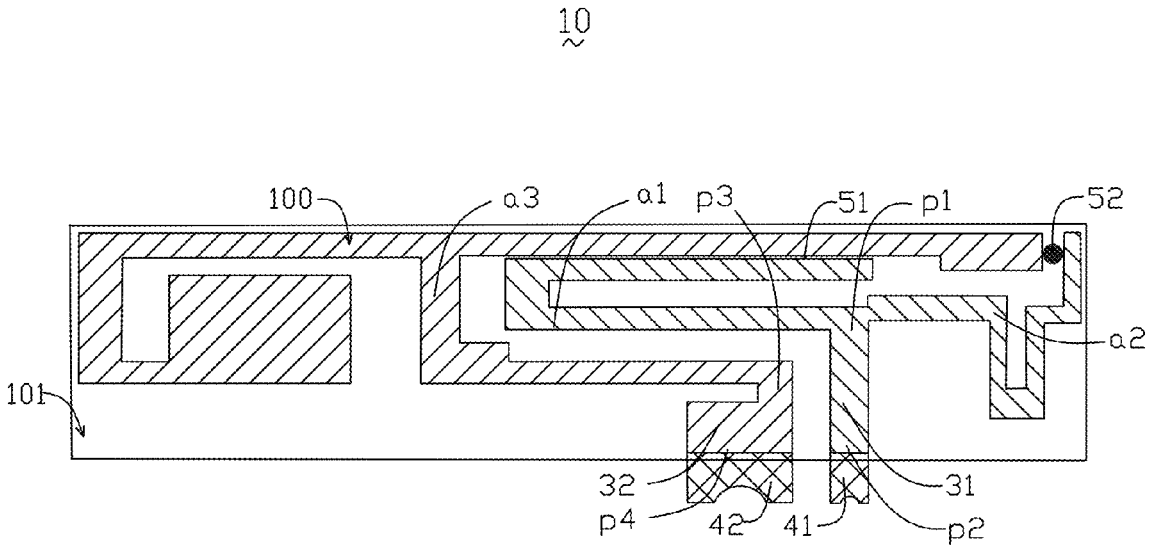
FIG. 1 is an illustrative structure of an antenna in accordance with an exemplary embodiment of the present disclosure.

Referring to FIG. 1, an antenna 10 of this embodiment includes an antenna body 100 and a substrate 101 for supporting the antenna body 100. The antenna body 100 is mounted on a surface of the substrate 101 for example by etching or printing. The substrate 101 may be a FR4 substrate with a thickness of 0.5 mm and a form factor of 55 mm×12 mm. Alternatively, the substrate 101 can be provided with other dimensions in order to match an exact mobile device.

The antenna body 100 includes a coupling portion 31, a radiation body, and a ground connection portion 32 which is configured corresponding to the coupling portion 31. The coupling portion 31 includes a first end p1 and a second end p2 opposite to the first end p1. The ground connection portion 32 includes a third end p3 and a fourth end p4 opposite to the third end p3. Herein, the radiation body includes a first antenna portion a1 extending from the first end p1 of the coupling portion 31 in a first direction, and a second antenna portion a2 extending from the first end p1 in a second direction opposite to the first direction. The radiation body further includes a third antenna portion a3 extending from the third end p3 of the ground connection portion 32, in a direction surrounding the first antenna portion a1. Gaps 52, 51 are provided for separating the third antenna portion a3 from the first antenna portion a1 and the second antenna portion a2 respectively. The ground connection portion 32 forms a ground connection point 41 at the second end p2 and the coupling portion 31 forms a feed point 42 at the fourth end p4.

Figure 2:
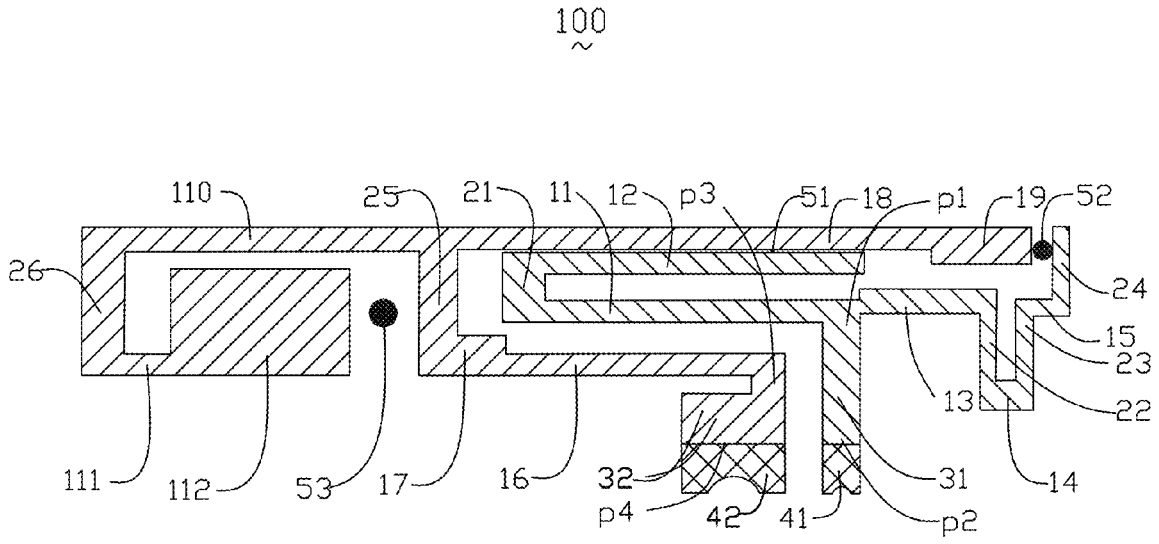
FIG. 2 is a plan view of an antenna body used in the antenna shown in FIG. 1.

Referring to FIG. 2, the first antenna portion a1 includes a first horizontal radiation strip 11, a first longitudinal radiation strip 21 and a second horizontal radiation strip 12. Herein, the first horizontal radiation strip 11 extends horizontally from the first end of the coupling portion 31, in a direction toward the ground connection portion 32, the first longitudinal radiation strip 21 vertically extends upward from the first horizontal radiation strip 11, and the second horizontal radiation strip 12 horizontally extends from the first longitudinal radiation strip 21, in a direction toward the coupling portion 31.

Referring to FIG. 2, the second antenna portion a2 includes a third horizontal radiation strip 13 extending from the first end p1 in a direction opposite to the first horizontal radiation strip 11, a second longitudinal radiation strip 22 vertically extending downward from the third horizontal radiation strip 13, a fourth horizontal radiation strip 14 horizontally extending from the second longitudinal radiation strip 22 in a direction away from the coupling portion 31, a third longitudinal radiation strip 23 vertically extending upward from the fourth horizontal radiation strip 14, a fifth horizontal radiation strip 15 horizontally extending from the third longitudinal radiation strip 23 in a direction away from the coupling portion 31 and a fourth longitudinal radiation strip 24 vertically extending upward from the fifth horizontal radiation strip 15. A longitudinal width of the third horizontal radiation strip 13 is greater than that of the first horizontal radiation strip 11.

Referring to FIG. 2, the third antenna portion a3 includes a sixth horizontal radiation strip 16 horizontally extending from the third end p3 of the ground connection portion 32 in a direction away from the coupling portion 31, a seventh horizontal radiation strip 17 horizontally extending from the sixth horizontal radiation strip 16, a fifth longitudinal radiation strip 25 vertically extending upward from the seventh horizontal radiation strip 17, an eighth horizontal radiation strip 18 horizontally extending from the fifth longitudinal radiation strip 25 toward the fourth longitudinal radiation strip 24, and a ninth horizontal radiation strip 19 horizontally extending from the eighth horizontal radiation strip 18 in the same direction with the eighth horizontal radiation strip 18. A cavity 20 is formed by the sixth horizontal radiation strip 16, the seventh horizontal radiation strip 17, the fifth longitudinal radiation strip 25 and the eighth horizontal radiation strip 18, so that the first antenna portion a1, i.e., the strips 11,21 and 12, can be positioned in the cavity 20. As the eighth horizontal radiation strip 18 is located at a position parallel to the second horizontal radiation strip 12, and a first gap 51 is configured between those two strips 12 and 18, a first gap coupling is accordingly achieved. A width of the first gap 51 is substantially 0.17 mm.

Furthermore, a longitudinal width of the ninth horizontal radiation strip 19 is greater than that of the eighth horizontal radiation strip 18, and the ninth horizontal radiation strip 19 is further positioned between the second horizontal radiation strip 12 and the fourth longitudinal radiation strip 24. Therefore, a second gap coupling is accordingly achieved for a second gap is formed between the ninth horizontal radiation strip 19 and the fourth longitudinal radiation strip 24.

The antenna body 100 further includes a tenth horizontal radiation strip 110 extending from the fifth longitudinal radiation strip 25 in a direction opposite to the eighth horizontal radiation strip 18, a sixth longitudinal radiation strip 26 vertically extending downward from the tenth horizontal radiation strip 110, an eleventh horizontal radiation strip 111 horizontally extending from the sixth longitudinal radiation strip 26 toward the ground connection portion 32 and a twelfth horizontal radiation strip 112 horizontally extending from the eleventh horizontal radiation strip 111 toward the ground connection portion 32. A longitudinal width of the twelfth horizontal radiation strip 112 is greater than that of the eleventh horizontal radiation strip 111. A third gap 53 is configured between the twelfth horizontal radiation strip 112 and the fifth longitudinal radiation strip 25, thus forming a third gap coupling to achieve goals of band expansion.

For the gap couplings mentioned above, advantageously, the first antenna body a1 covers operation frequencies of 1.565-1.612 GHz, the second antenna body a2 covers operation frequencies of 1.930-2.690 GHz, and the third antenna body a3 covers low operation frequencies for example of 0.734-0.960 GHz.

Figure 3:
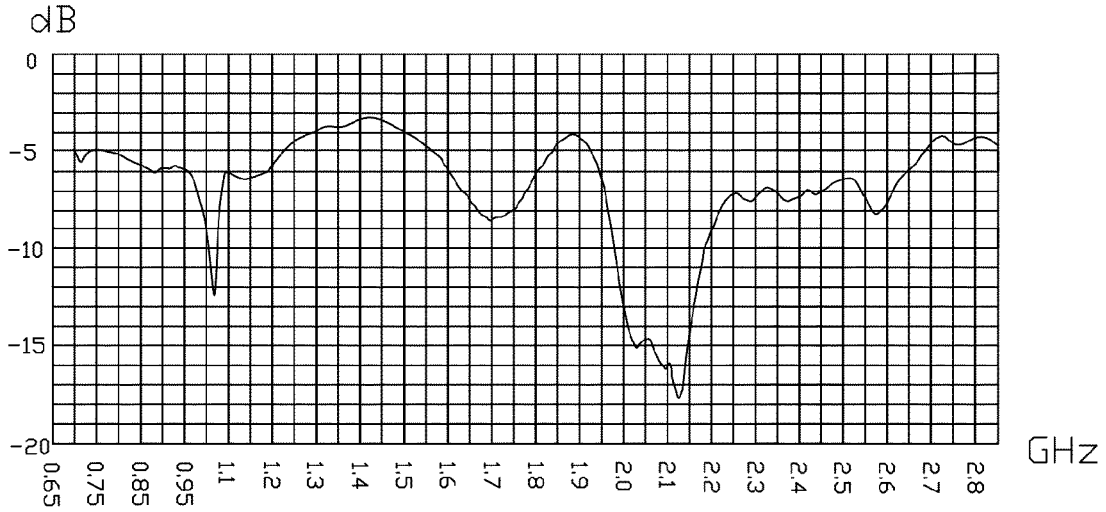
FIG. 3 is a diagram of a measured return loss of the antenna in FIG. 1.

As shown in FIG. 3, a diagram of a measured return loss of the antenna 10 in FIGS. 1-2 is illustrated, wherein the X axis represents the operating frequency and the Y axis represents to the return loss. In this case, a 50 Ohms coaxial cable is connected to the antenna to feed the antenna 10, so that the antenna 10 can be implemented on a mobile device such as a mockup tablet. Obviously, the antenna exhibits an average gain performance of −3.3 dB at GPS bands. As for the low and higher frequency bands, the return losses of the antenna are also acceptable. Therefore, the antenna in the present disclosure can meet requirements of multiple mobile devices, for covering multi-band and broad bands.

It is to be understood, however, that even though numerous characteristics and advantages of the present embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An antenna, comprising:

a coupling portion, comprising a first end and a second end opposite to the first end;

a ground connection portion corresponding to the coupling portion, comprising a third end and a fourth end opposite to the third end; and a radiation body, comprising:

a first antenna portion extending from the first end in a first direction, a second antenna portion extending from the first end in a second direction opposite to the first direction, and a third antenna portion extending from the third end in a direction surrounding the first antenna portion, wherein two gaps are provided for separating the third antenna portion from the first antenna portion and the second antenna portion respectively; wherein, the first antenna portion comprises:

a first horizontal radiation strip, horizontally extending from the first end of the coupling portion in a direction close to the ground connection portion:

a first longitudinal radiation strip, vertically extending upward the first horizontal radiation strip; and a second horizontal radiation strip, horizontally extending from the first longitudinal radiation strip in a direction close to the coupling portion;

the second antenna portion comprises:

a third horizontal radiation strip, extending from the first end in a direction opposite to the first horizontal radiation strip;

a second longitudinal radiation strip, vertically extending downward from the third horizontal radiation strip;

a fourth horizontal radiation strip, horizontally extending from the second longitudinal radiation strip in a direction away from the coupling portion;

a third longitudinal radiation strip, verticality extending upward from the fourth horizontal radiation strip;

a fifth horizontal radiation strip, horizontally extending from the third longitudinal radiation strip in a direction away from the coupling portion; and a fourth longitudinal radiation strip vertically extending, upward from the fifth horizontal radiation strip; wherein, the third antenna portion comprises:

a sixth horizontal radiation strip, horizontally extending from the ground connection portion in a direction away from coupling portion;

a seventh horizontal radiation strip horizontally extending from the sixth horizontal radiation strip;

a fifth longitudinal radiation strip vertically extending upward from the seventh horizontal radiation strip;

an eighth horizontal radiation strip, horizontally extending from the fifth longitudinal radiation strip toward the fourth longitudinal radiation strip; and a ninth horizontal radiation strip, horizontally extending from the eighth horizontal radiation strip;

wherein, the two gaps comprise a second gap between the ninth horizontal radiation strip and the fourth longitudinal radiation strip, for separating the third antenna portion from the second antenna portion.

2. The antenna as described in claim 1 further comprising a substrate on which the coupling portion, the ground connection portion, and the radiation body are positioned.

3. The antenna as described in claim 1, wherein, the ground connection portion forms a ground connection point at the second end.

4. The antenna as described in claim 1, wherein the coupling portion forms a feed point at the fourth end.

5. The antenna as described in claim 1, wherein, a cavity is formed by the sixth horizontal radiation strip, the seventh horizontal radiation strip, the fifth longitudinal radiation strip and the eighth horizontal radiation strip, wherein the first antenna portion is accommodated in the cavity.

6. The antenna as described in claim 5, wherein, the two gaps comprise a first gap between the second horizontal radiation strip and the eighth horizontal radiation strip, for separating the first antenna portion from the third antenna portion, wherein a width of the first gap is 0.17 mm.

7. The antenna as described in claim 6, wherein, a longitudinal width of the third horizontal radiation strip is greater than that of the first horizontal radiation strip.

8. The antenna as described in claim 7, wherein, a longitudinal width of the ninth horizontal radiation strip is greater than that of the eighth horizontal radiation strip, and the ninth horizontal radiation strip is positioned between the second horizontal radiation strip and the fourth longitudinal radiation strip.

9. The antenna as described in claim 8, wherein, the antenna further comprises: a tenth horizontal radiation strip, extending from the fifth longitudinal radiation strip in a direction opposite to the eighth horizontal radiation strip;

a sixth longitudinal radiation strip, vertically extending downward from the tenth horizontal radiation strip;

an eleventh horizontal radiation strip, horizontally extending from the sixth longitudinal radiation strip toward the ground connection portion; and a twelfth horizontal radiation strip, horizontally extending from the eleventh horizontal radiation strip.

10. The antenna as described in claim 9, wherein, a third gap is defined between the twelfth horizontal radiation strip and the fifth longitudinal radiation strip.

11. The antenna as described in claim 1, wherein, the second gap is wider than the first gap.

* * * * *